United States Patent [19]
Meidel

[11] 4,454,673
[45] Jun. 19, 1984

[54] AUTOMATIC SAFETY DEVICE FOR HANDGUNS

[75] Inventor: Herbert Meidel, Oberndorf-Aistaig, Fed. Rep. of Germany

[73] Assignee: Heckler & Koch GmbH, Oberndorf, Fed. Rep. of Germany

[21] Appl. No.: 377,405

[22] Filed: May 12, 1982

[30] Foreign Application Priority Data

May 20, 1981 [DE] Fed. Rep. of Germany ..... 3120024

[51] Int. Cl.[3] ..... F41C 17/04
[52] U.S. Cl. ..... 42/70 F; 42/70 R
[58] Field of Search ..... 42/70 F, 66, 70 R, 70 C, 42/70 D

[56] References Cited

U.S. PATENT DOCUMENTS

| | | | |
|---|---|---|---|
| 3,626,622 | 12/1971 | Uberti | 42/66 |
| 3,724,113 | 4/1973 | Ludwig | 42/70 F |
| 3,942,278 | 3/1976 | Schaller et al. | 42/70 F |
| 4,011,678 | 3/1977 | Brodbeck et al. | 42/70 F |

FOREIGN PATENT DOCUMENTS

| | | | |
|---|---|---|---|
| 660046 | 10/1951 | United Kingdom | 42/70 F |

*Primary Examiner*—Charles T. Jordan
*Assistant Examiner*—Ted L. Parr
*Attorney, Agent, or Firm*—Burmeister, York, Palmatier, Hamby & Jones

[57] ABSTRACT

The invention concerns an automatic safety device for handguns and especially for self-loading pistols, in which a longitudinally movable firing pin is secured positively by a spring-loaded safety member which, on the one hand, is carried in a recess in the weapon and, on the other, engages in a transverse recess in the firing pin. For the release of a shot, the safety member is forced out of the firing pin area by the trigger before the release of a hammer. In order to achieve an enhanced security against unintended release, e.g. through shock or fall of the weapon, as well as a more economical production, the safety member is in the form of a rocker which engages in the firing pin with an arm and is preferably accommodated in a slot in a bolt, in some cases rotatable, arranged at right angles to the weapon.

9 Claims, 5 Drawing Figures

AUTOMATIC SAFETY DEVICE FOR HANDGUNS

FIELD OF THE INVENTION

The invention concerns an automatic safety device for handguns, especially for self-loading pistols, with a longitudinally movable firing pin which is automatically and positively secured by a spring-loaded safety member against longitudinal movement due to the fact that the safety member is carried in a recess in a breech piece or weapon part at right angles to the firing pin length and engages in a recess in the firing pin, and, upon activation of a trigger before release of a hammer via a release, can be swung against the force of a spring out of the way of the firing pin.

BACKGROUND OF THE INVENTION

Several such automatic safety devices for the firing pin of a handgun have become known (Walther pistol model P 38, Czech Army pistol model 52, Great Britain Pat. No. 660,046, German patent application DE-OS 25 28 831). These safeties have proven themselves. In order to prevent the safety being dislodged by inertial force in case of a blow or shock, e.g. in a fall of the weapon, the last-named known self-loading pistol has a fall protection device, similar in principle, that positively stops the firing pin only if the firing pin safety becomes disengaged through high acceleration. This is achieved by having the engagement direction of the two safety devices be opposed. This additional fall protection device means, however, a practically double manufacturing cost, because two safety members—two springs and two recesses in the weapon, on the one hand, and two recesses in the firing pin, on the other—must be provided.

SUMMARY OF THE INVENTION

It is the object of the present invention to create a safety device of the type named at the beginning, including a fall protection device, at a lower cost and without detracting from the safety function. The safety device must at the same time be easily accessible, and additional safety functions must be ensured in a simple manner.

This object is achieved according to the invention with an automatic safety device of the type described at the beginning, whose safety member is a rocker that is pivotable around a shaft parallel to the longitudinal direction of the firing pin, the two arms of the rocker having approximately equal masses, and the rocker being held in a secured position by means of a spring acting on at least one arm.

Through the use of a rocker with arms of almost equal mass, the function of fall protection can at the same time also be fulfilled by the automatic firing pin safety, thereby halving the cost hitherto necessary for an automatic firing pin safety, on the one hand, and for a fall protection device, on the other.

The safety member is carried in a recess that, in automatic handguns like self-loading pistols, is made in the breechblock surrounding the firing pin; in the case of revolvers and non-automatically reloading weapons, the recess could be made in the weapon casing. Here, though, there is always the disadvantage that the recess must be made in the interior and therefore its formation is made difficult. Also, such safeties are not easily accessible, which is especially disadvantageous because the operability of the safety—easy action, perfect edges, effectiveness of the spring loading—must be subject to involved and accurate testing. In a preferred embodiment of the invention, therefore, the rocker is accommodated in a groove of a bolt arranged at right angles to the firing pin direction. This bolt is, in the simplest case, inserted at right angles into the breechblock, so that, on the one hand, it is easily installable and removable and, on the other hand, it is easy to produce. This also makes possible, if desired, the easy and convenient inspection of the safety device.

In an especially preferred embodiment of the invention, the bolt is rotatably supported and at its end has a manually operated safety lever, the automatic safety device being in its operative position in the angular position "F" (fire, safety off). This embodiment has the advantage that the bolt serves at the same time as a safety shaft. Whereas, according to the previously explained embodiment, the rocker has a fixed position within an inserted bolt, and therefore this embodiment is especially suitable for a weapon in which no additional safety features are desired, the embodiment with a rotatable bolt opens up the possibility of providing a manually engageable safety. If the bolt and safety lever are in the angular position "F" (fire, safety off), then the automatic firing pin safety is in its operative position. If the safety lever is turned to the "S" position (safety on), then it takes on other safety functions, e.g. a manual locking of the firing pin and/or locking of the trigger or the like. In the "S" position of the bolt or of the safety lever, therefore, the rocker is disengaged from the firing pin, because it is tilted away, and instead the firing pin is positively secured by means of a surface of the bolt when pivoted in this position. For example, the bolt is provided with an oblique surface and the firing pin likewise with a corresponding oblique surface which, in the "S" position of the bolt, are in contact with each other or face each other at a slight distance, whereby the firing pin is positively secured against striking the cartridge.

The rotatable bolt, however, also makes possible the realization of additional, manually engageable safeties. In a preferred embodiment of the invention, in the "S" position of the bolt or safety lever, the bolt blocks the release and, by way of the release, the trigger, with the release being constituted by an arm formed on a trigger catch engageable by a sear, adapted to operate a detent stop lever. The sear, again, is pivoted on the trigger in a known manner, and the trigger catch is preferably pivotable.

Or, according to another preferred embodiment of the invention, the release is a slide which is movable by the sear and can be deflected out at right angles to the direction of motion by an oblique cam surface. In the "S" position of the safety bolt, the slide is blocked, as is the trigger, because of its connection to the slide.

Further details and developments of the present invention are made clear from the following description of embodiments represented in the drawings, in connection with the claims.

The figures show in a simplified and schematic representation that leaves out all details not required for the understanding of the invention, using a self-loading pistol as an example.

DETAILED DESCRIPTION OF ILLUSTRATIVE EMBODIMENTS

Figure 1:
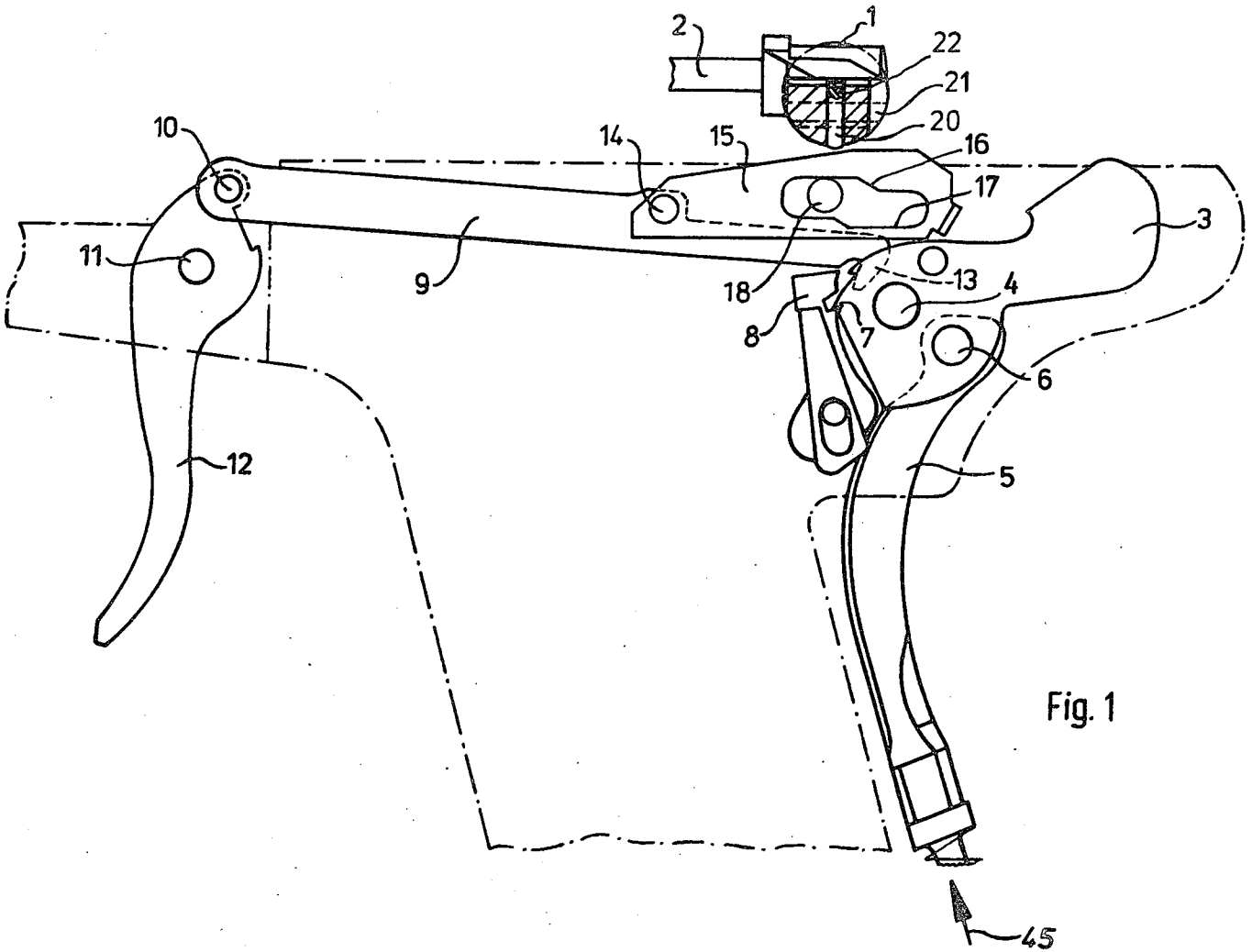
FIG. 1 shows a partial longitudinal section through the trigger and safety area of a self-loading pistol with a pusher or release slide for the disengagement of the automatic safety.

As shown in FIG. 1, a bolt 1 serving as a safety shaft is rotatably supported at right angles to the shooting direction in a not further represented breechblock of a self-loading pistol. In the breechblock, further, with its longitudinal extension in the shooting direction, is located a longitudinally displaceable firing pin 2, the rear section only of which is shown in the drawings, and on which a hammer 3 impacts upon the release of a shot. The hammer 3 rotates around a pin 4 in the weapon. On the hammer, a rod 5 is supported to rotate around a pin 6 solidly attached to the hammer 3. The rod is loaded in the direction of the arrow 45 by a hammer spring which, in a known manner not shown, is accommodated in the pistol stock parallel to a magazine. The hammer 3 has a detent 7 in which a stop lever 8 engages, in the cocked position of the hammer 3. A sear 9 is linked on a pin 10 of a trigger 12 that rotates around a shaft 11 in the stock. The sear 9 has on its end a hook 13 that engages behind the end of the stop lever 8 and upon activation of the trigger 12 lifts the stop lever 8 out of the detent 7 on the hammer 3, which then is caused by the hammer spring via the rod 5 to strike against the rear end of the firing pin 2 and to drive the latter against the primer of the cartridge. On the sear 9, linked to rotate around a shaft 14, there is a slide 15 formed with a slot 17 having a slanting cam surface 16, adapted to slide along a fixed pin 18 on the body of the weapon, when the trigger 12 is moved. By means of the slanting surface 16, the slide 15 is raised by the transverse pin 18, so that the slide presses on an arm 19 of a rocker 20, serving as a safety member, which rotates around a pin 21 extending parallel to the longitudinal direction of the firing pin 2 and inserted into a borehole in the bolt 1. A slot 22 is formed in the bolt 1 to receive the rocker 20. Also, a radial borehole 23 is made in the bolt 1 to accommodate a compression spring 24 whose other end is in contact with the arm 19 of the rocker 20 and is secured thereto by a projection 25, against slipping off.

Another arm 26 of the rocker 20 extends into a transverse slot 27 in the firing pin 2, and thereby blocks the latter against any movement in its longitudinal direction. If the weapon falls or receives a shock in any other way, then the firing pin is reliably prevented by the rocker 20 from striking and detonating the carriage. And it makes no difference whether the hammer 3 is released by the shock too, because the safety member in the form of the rocker 20 is right in a position to absorb the blow of the hammer 3 without any damage. Only when the trigger 12 is pulled, so that the slide 15 causes the rocker 20 to rotate against the force of the compression spring 24 until the arm 26 comes out of the transverse slot 27, can the firing pin be driven forward by the hammer 3 to fire the cartridge. Because the width of the slot 17 corresponds with the diameter of the transverse pin 18, the pin prevents mass accelerations from giving rise to a transverse motion of the slide 15 and thereby prevents the slide from causing any rotation of the rocker 20.

Figure 2:
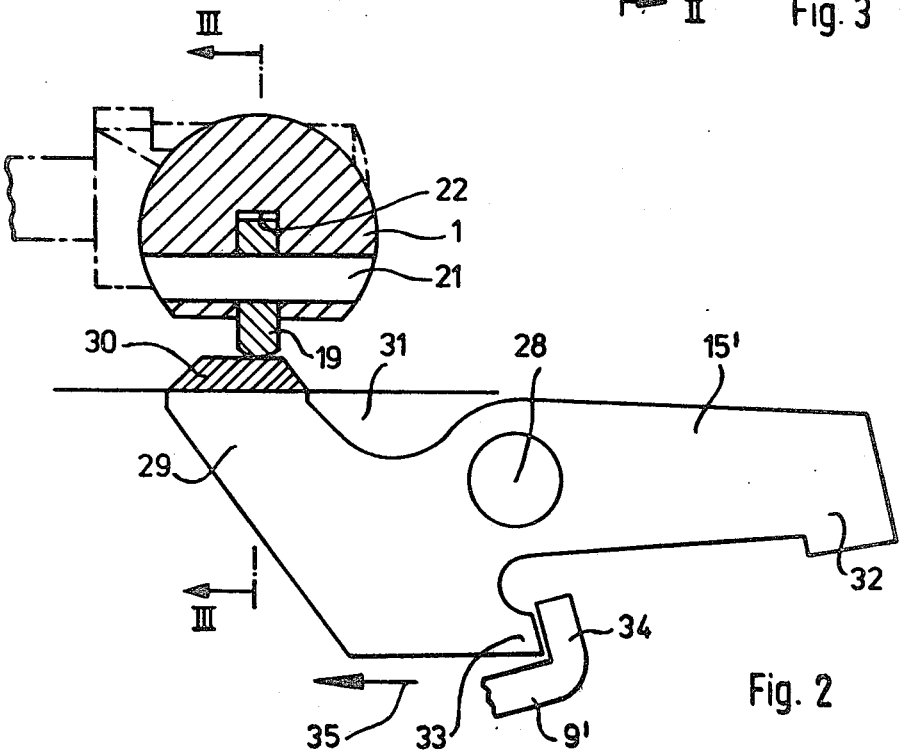
FIG. 2 shows a partial longitudinal section in the plane II—II of FIG. 3 through a self-loading pistol with a trigger catch, instead of the slide.

As seen in FIG. 2 instead of the slide 15, a trigger catch 15' can be used that swivels around a pin 28. The trigger catch 15' has an arm 29 with a truncated end 30 which, on the one hand, is in contact with the arm 19 of the rocker 20 and, on the other hand, with the side wall of the stock 31. Another arm 32 of the trigger catch 15' serves to dislodge a catch lever, not shown, for the release of the hammer. The trigger catch 15' is also provided with a projection 33 which is engaged by a hooked end 34 of a sear 9' which is moved by the trigger in the direction of the arrow 35.

Figure 3:
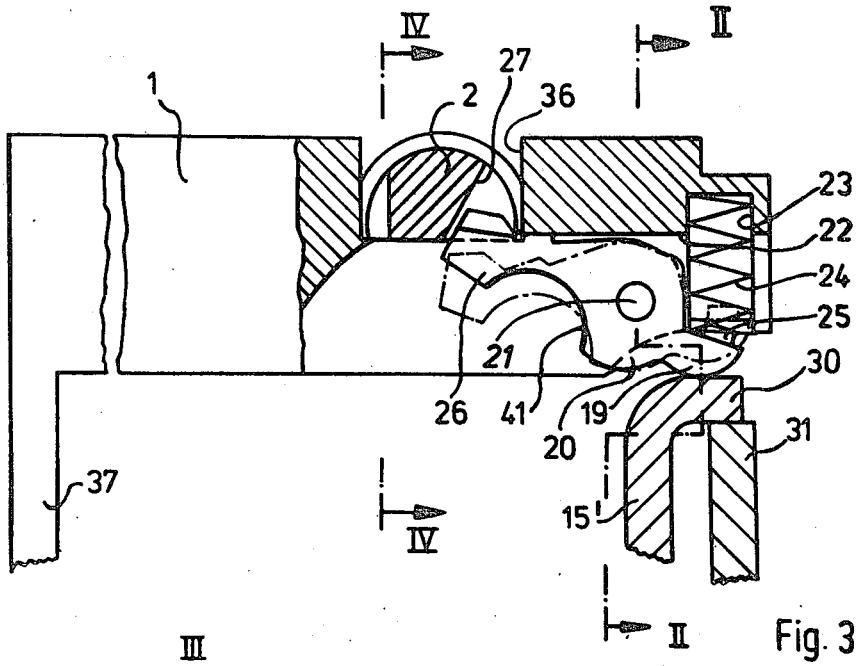
FIG. 3 shows a section in the plane III—III of FIG. 2 in position "F" of the safety lever, or with a non-rotating safety bolt.

In the representation of FIG. 3, the bolt 1 has a transverse slot 36 which serves as a guide for the firing pin 2. On at least one end of the bolt 1, which is rotatable to a limited degree around its longitudinal axis in a breechblock not shown, there is a safety lever 37 which can be moved manually into the positions "S" (safety) and "F" (fire). The automatic safety, formed by the rocker 20, is operative when the bolt 1 is in the "F" position, as shown in FIG. 3 and also in FIG. 2.

Figure 4:
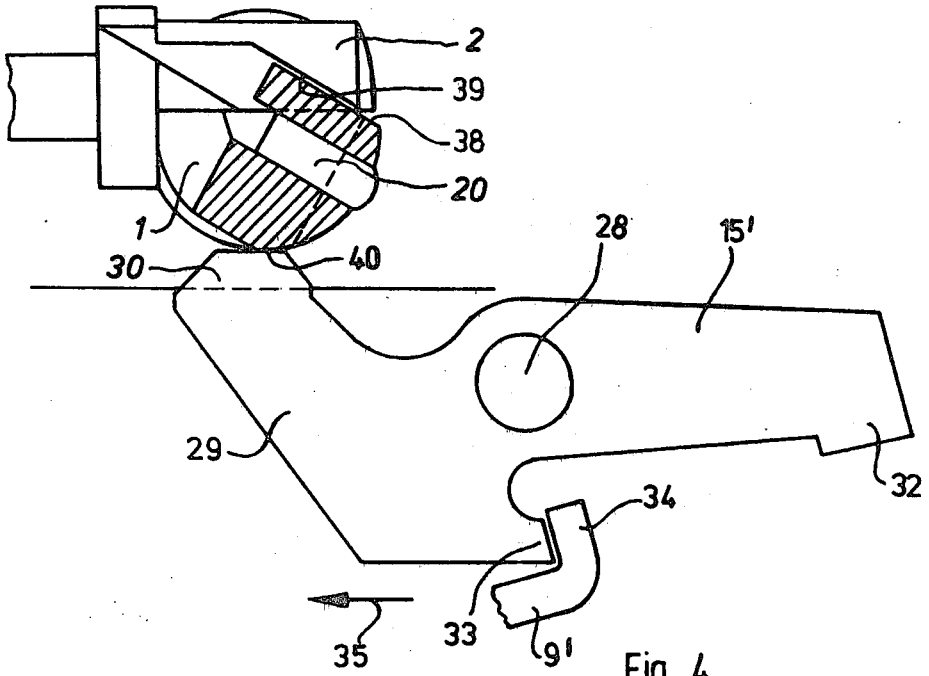
FIG. 4 shows a section in the plane IV—IV of FIG. 3, in the "S" position of the safety lever.
Figure 5:
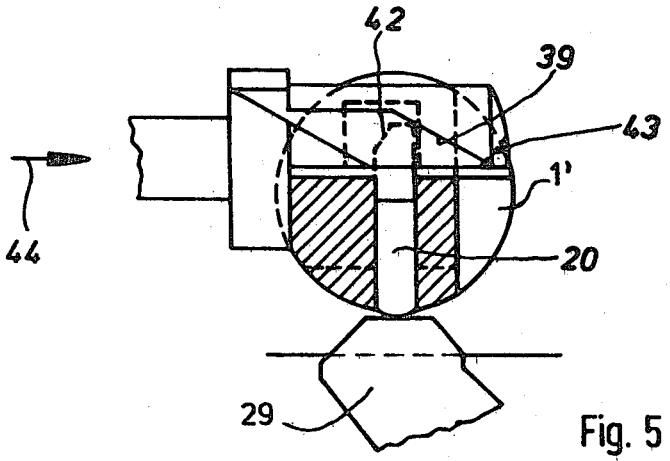
FIG. 5 shows a section in the plane IV—IV in the position "F" of the safety lever, or with a non-rotating bolt.

In FIG. 4, the bolt 1 is shown in the "S" position, in which it is turned about 60°. In this manner, of course, the arm 26 of the rocker 20 becomes disengaged from the firing pin 2 but, on the other hand, an oblique surface 38 formed on the bolt 1 comes into the path of a matching oblique surface 39 on the firing pin 2, whereby the latter is positively prevented from moving in the direction of the cartiridge. Thereby, the securing of the firing pin is achieved, even in the "S" position. Furthermore, in this position, a peripheral surface 40 of the bolt 1 blocks the truncated end 30 of the trigger catch 15', supported against the side wall of the stock, whereby, also, the hooked end 34 cannot be pulled in the direction of the arrow 35 and, thus, the trigger also is locked. Thus, in this manually secured position, both a firing pin safety and also a trigger safety are realized.

There are cases that require quick firing readiness in a self-loading pistol; here it is desirable to dispense with a manually activated safety whose operation would delay the shooting readiness of the weapon, and in exceptional situations might endanger the safety of the shooter, but it is also desirable to avoid detracting from the safety of the weapon. This requirement can be met by the automatic firing pin safety and fall protection according to the present invention which, while maintaining adequate securing against involuntary discharge of a shot, requires no action on the part of the shooter to put the safety on or off. In this case, instead of the rotatable bolt 1, a rigid solidly inserted bolt 1' is used, which means that there is no safety lever 37. The firing pin 2 does not need the oblique surface 39 in this type of application; in the interest of a simplified stockkeeping or conversion, however, the oblique surface can be provided. The same thing holds true for the oblique surface 38 of the bolt 1.

It is necessary to provide an oblique surface 42 on the rocker 20 and an oblique surface 43 on the firing pin 2, in order to guarantee that, after the re-installation of the safety bolt or shaft 1, the firing pin 2, under the pressure of the firing pin spring, exerts extra pressure on the rocker 20 in the direction of the arrow 44, so that the latter automatically engages in the transverse slot 27 of the firing pin 2, and the firing pin 2 is fixed in the "safety" position.

It goes without saying that the invention is not limited to the embodiments represented, but that deviations therefrom are possible within the scope of the invention. For example, the approximately equal masses of the two arms 19 and 26 can be achieved by means of different thicknesses, a recess 41 in the arm 26 or by both means in combination.

A certain inequality of mass does no harm as long as the torque produced thereby in the most unfavorable case is smaller than the torque exerted by the compression spring 24 to keep the rocker 20 engaged in the firing pin 2.

I claim:

1. Automatic safety device for handguns, especially self-loading pistols, with a longitudinally movable firing pin which by a spring loaded safety member in a safety bolt is secured positively against longitudinal movement by the fact that the safety member is carried in a recess in a weapon part at right angles to the firing pin, being rotatable out of the path of the firing pin upon the activation of a trigger before the release of a hammer via a release against the force of a spring, characterized by the fact that the safety member is a rocker that rotates around a shaft parallel to the firing pin longitudinal direction, that the rocker has two arms having approximately equal masses and extending in directions approximately 180° apart to neutralize the effects of shock, and that the rocker is held in a secured position by the spring loading at least one arm.

2. Automatic safety device for handguns, especially self-loading pistols, with a longitudinally moving firing pin which by a spring loaded safety member in a safety bolt is secured positively against longitudinal movement by the fact that the safety member is carried in a recess in a weapon part at right angles to the firing pin but rotatable out of the path of the firing pin upon the activation of a trigger before the release of a hammer via a release against the force of a spring, characterized by the fact that the safety member is a rocker that rotates around a shaft parallel to the firing pin longitudinal direction, that the rocker has two arms having approximately equal masses approximately balanced relative to shock, and that the rocker is held in a secured position by the spring loading at least one arm, and that the rocker is accommodated in a slot in the bolt arranged at right angles to the firing pin direction.

3. Automatic safety device for handguns, especially self-loading pistols, with a longitudinally moving firing pin (2) which by a spring loaded safety member (20) is secured positively against longitudinal movement by the fact that the safety member is carried in a recess in a weapon part at right angles to the firing pin (2) but rotatable out of the path of the firing pin (2) upon the activation of a trigger (12) before the release of a hammer (3) via a release (15 or 15') against the force of a spring (24), characterized by the fact that the safety member is a rocker (20) that rotates around a shaft parallel to the firing pin longitudinal direction, that the rocker (20) has two arms having approximately equal masses approximately balanced relative to shock, and that the rocker is held in a secured position by the spring loading at least one arm (19), and that the rocker (20) is accommodated in a slot (22) in a bolt (1 or 1') arranged at right angles to the firing pin direction.

4. Automatic safety device as described in claim 3, characterized by the fact that the bolt (1) is rotatable between a fire position and a safety position and has attached at one end a manually operable safety lever (37), automatic safety being operative in the fire position.

5. Automatic safety device as described in claim 4, characterized by the fact that in the safety position of the bolt (1) or safety lever (37) the rocker (20) is disengaged from the firing pin and instead the firing pin (2) is secured positively by an oblique surface (38) of the bolt (1).

6. Automatic safety device as described in claim 5, characterized by the fact that in the safety position of the bolt (1) or safety lever (37) the bolt (1) stops a firm support truncated end (30) of a trigger catch (15') provided with an arm (29) as the release, whereby via a projection (33) of the trigger catch (15') a sear (9'), and therewith the trigger (12), is blocked.

7. Automatic safety device as described in claim 6, characterized by the fact that the trigger catch (15') is rotatable.

8. Automatic safety device as described in claim 4, characterized by the fact that the release is a slide (15) that is movable by a sear (9) and which by means of an oblique surface (16) is deflectable at right angles to the displacement direction for disengagement of the automatic safety member (20).

9. Automatic safety device as described in claim 8, characterized by the fact that in the safety position the slide (15) and therewith the trigger (12) connected with it via the sear (9) is blocked.

* * * * *